United States Patent [19]

Collins, Jr. et al.

[11] Patent Number: 5,031,549

[45] Date of Patent: Jul. 16, 1991

[54] METHOD OF INTRODUCING AIR INTO A ROTARY COMBUSTOR

[75] Inventors: William G. Collins, Jr., Hempfield Township, Westmoreland County; Suh Y. Lee, Monroeville, both of Pa.

[73] Assignee: Westinghouse Electric Corp., Pittsburgh, Pa.

[21] Appl. No.: 592,734

[22] Filed: Oct. 4, 1990

[51] Int. Cl.[5] ..... F23G 5/00; A47J 36/00

[52] U.S. Cl. ..... 110/346; 110/226; 110/246; 110/300; 432/106; 432/113

[58] Field of Search ..... 432/77, 105, 106, 107, 432/103, 113; 110/246, 346, 226, 298, 299, 300; 122/11

[56] References Cited

U.S. PATENT DOCUMENTS

| | | | |
|---|---|---|---|
| 3,152,796 | 10/1964 | Ramstack, Jr. | 110/246 |
| 4,226,584 | 10/1980 | Ishikawa | 432/77 |
| 4,266,931 | 5/1981 | Struckmann | 432/105 |
| 4,784,604 | 11/1988 | O'Connor | 432/107 |
| 4,870,912 | 10/1989 | Lee | 110/246 |

*Primary Examiner*—Edward G. Favors

*Attorney, Agent, or Firm*—Fred J. Baehr, Jr.

[57] ABSTRACT

An improved method of introducing air into a rotary combustor for burning municipal solid waste in an incinerator, wherein a large amount of air is introduced over the top portion of the combustor adjacent the outlet end thereof to maintain the CO at acceptable low levels in response to a reduction in the amount of oxygen in the flue gas even when varying amounts of high heating value materials are introduced sporadically.

5 Claims, 2 Drawing Sheets

METHOD OF INTRODUCING AIR INTO A ROTARY COMBUSTOR

BACKGROUND OF THE INVENTION

The invention relates to a solid municipal waste incinerator with a rotary combustor and more particularly to a method of improving the introduction of air into the rotary combustor so as to substantially reduce the amount of carbon monoxide produced in burning municipal solid waste.

Incineration has proven to be a viable method of reducing the quantity of solid municipal waste that is disposed of in land fills and produce usable heat, which can be transformed into electricity. To meet the more demanding air pollution standards being imposed on the effluent stack gases from the incinerator and particularly reducing the amount of CO, while maintaining the $NO_x$ at a low level, it has become necessary to improve the combustion process within the rotary combustor.

SUMMARY OF THE INVENTION

Among the objects of the invention may be noted the provision of a method of improving combustion with in a rotary combustor burning municipal solid waste so as to substantially reduce the amount of CO and hydrocarbons in the effluent stack gases.

In general, an improved method of introducing air into a rotary combustor, when performed in accordance with this invention, comprises the steps of:

utilizing a rotary combustor formed from a cylindrical array of cooling tubes spaced apart by a web disposed between adjacent tubes, the webs having a plurality of openings disposed along their length for introducing combustion air into the rotary combustor and having an inlet end for introducing solid municipal waste and an outlet end from which ash and flue gases exit; feeding solid municipal waste into the inlet end of the rotary combustor; providing a plurality of wind boxes to feed air into the rotary combustor to separately provide underfire air, overfire air and overcombustor air; measuring the percent of oxygen in the flue gases; rapidly introducing overcombustor air into the rotary combustor in response to a drop in the percentage of oxygen in the flue gas to maintain the level of CO in the exhaust gases at acceptable levels.

BRIEF DESCRIPTION OF THE DRAWINGS

The invention as set forth in the claims will become more apparent by reading the following detailed description in conjunction with the accompanying drawings, wherein like reference numerals refer to like parts throughout the drawings and in which:

DESCRIPTION OF THE PREFERRED EMBODIMENT

Figure 1:
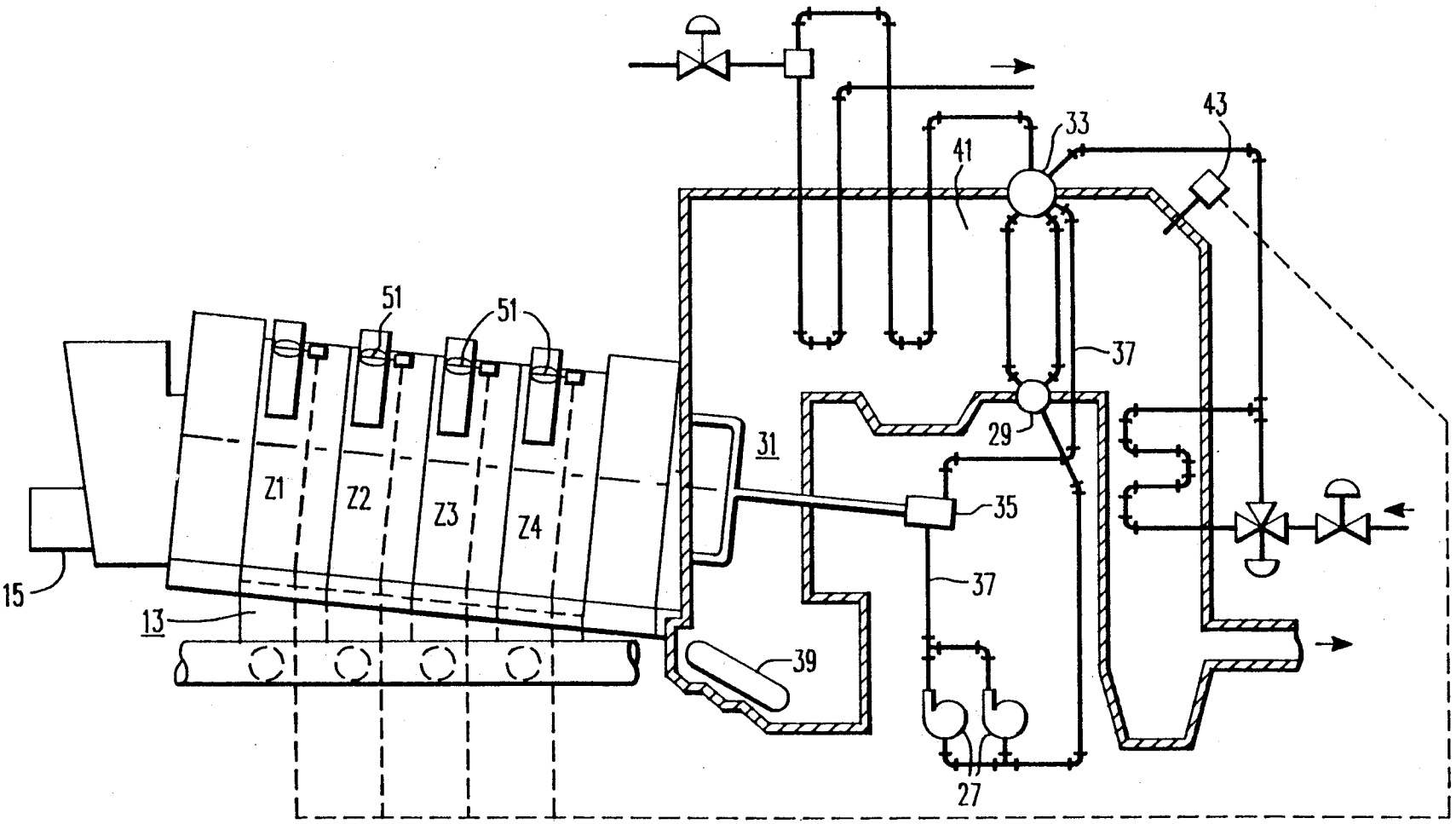
FIG. 1 is a schematic view of a municipal waste incinerator made in accordance with this invention.
Figure 2:
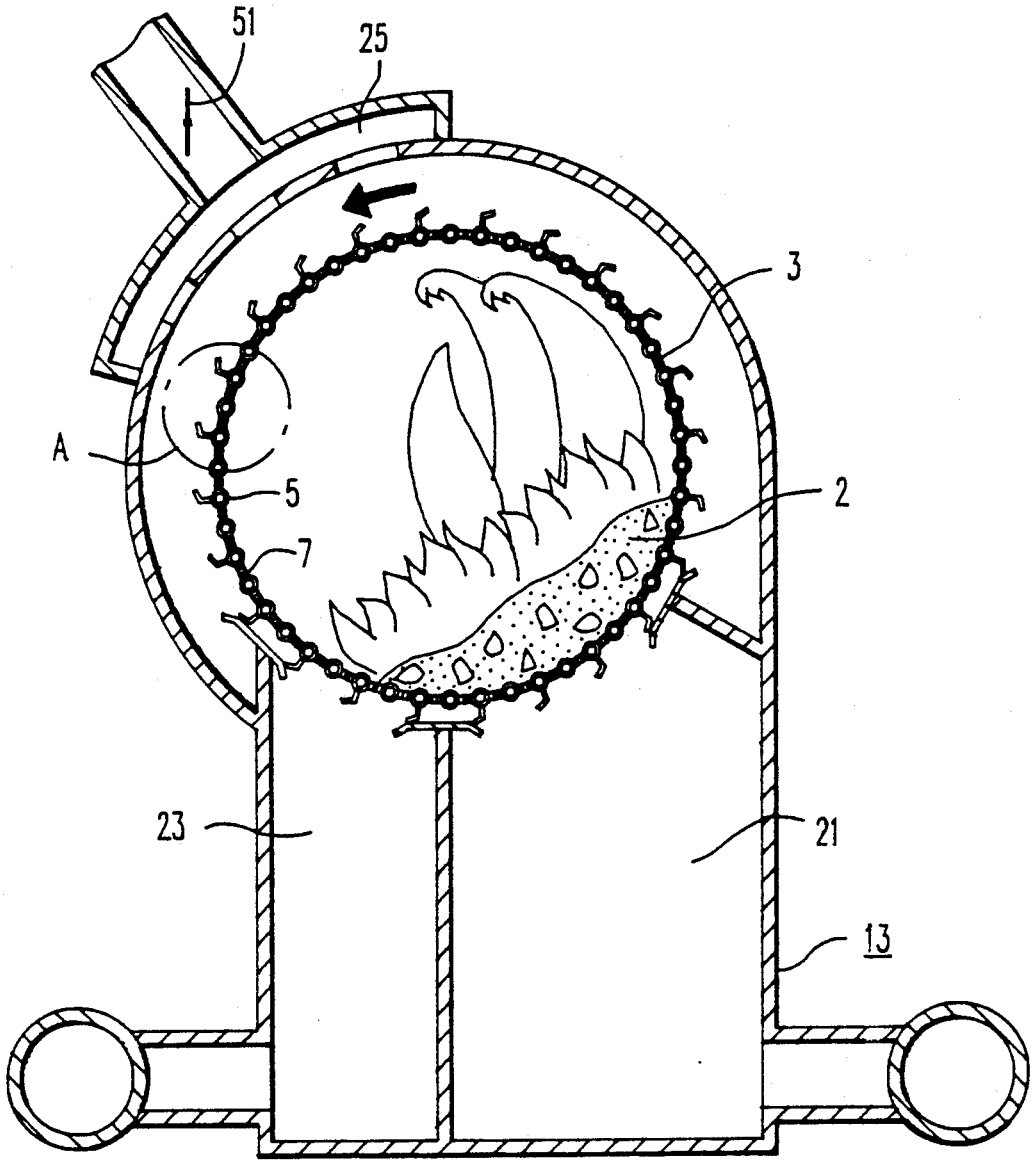
FIG. 2 is an enlarged partial sectional view of the rotary combustor and windbox adjacent the exit end of the combustor.
Figure 3:
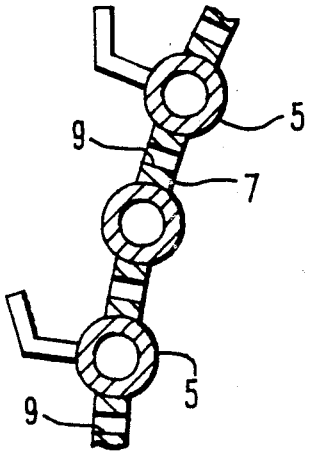
FIG. 3 is an enlargement of area A of FIG. 2.

Referring now to the drawings in detail and in particular to FIGS. 1, 2 and 3 there is shown an incinerator for burning municipal solid waste 2 in a rotary combustor 3. The rotary combustor 3, as shown best in FIGS. 2 and 3, is formed from a cylindrical array of tubes or pipes 5 with a flat plate or web 7 connecting adjacent pipes 5. The web 7 has a plurality of openings or holes 9 through which combustion air is supplied to the interior of the rotary combustor 3. The rotary combustor 3 is disposed to rotate on an inclined axis within a windbox 13. Municipal solid waste 2 to be incinerated is fed into an inlet end, the end shown on the left in FIG. 1, by a ram 15 and tumbles toward an outlet end as the combustor 3 rotates on metal tires, which engage spaced apart rollers (not shown). The holes or openings 9 in the webs 7 allow combustion air supplied from the wind box 13 to enter the rotary combustor 3. The burning tumbling waste 2, as shown in FIG. 2, tends to ride up on one side of the combustor 3 as it rotates. The wind box 13 is divided into a plurality of compartments for supplying combustion air to several separately controlled areas of the combustor 3 or zones Z1, Z2, Z3 and Z4. Zone Z1 is disposed adjacent the inlet end of the combustor 3 and zone Z4 is disposed adjacent the outlet end of the combustor 3. In each zone the windbox 13 is further divided into additional compartments or portions which supply air to the underside of the burning waste 2 and this portion is thus called an underfire windbox 21 and an adjacent windbox portion 23 is disposed to supply combustion air over the burning waste and is thus called the overfire windbox 23. There is an additional compartment or windbox portion 25, which supplies air to over the combustor and is called overcombustor windbox 25. A heater (not shown) is disposed to control the temperature of the combustion air in the various zones.

A cooling fluid, water, is circulated through the combustor tubes or pipes 5 to keep them and the webs 7 cool and increase their useful life. The water is supplied by a pair of pumps 27, which takes their suction from a water drum 29 in a waste heat water wall boiler 31 and returns the heated cooling fluid from the rotary combustor 3 to a steam drum 33 via a rotary joint 35 and associated piping 37. Solids including burnable, unburnables, ash and hot gases exit from the outlet end of the combustor 3. The solids fall on a burnout grate 39 and the hot gases and some fly ash flow upwardly in a furnace portion 41 of the boiler 31 and over an oxygen analyzer and controller 43.

Municipal solid waste 2 includes materials with high heating value and carbon content such as tires, sawdust, asphalt shingles and many other materials, which enter the combustor 3 on an irregular basis and in greatly varying quantities, cause rapid and sporadic fluctuations in the burning rate and fire temperature so that controlling the carbon monoxide, CO, in the flue gases within defined limits over a relatively short time span, for example 100 ppm average over one hour, requires rapid response to these variations to prevent high CO spikes, which drive the average out of acceptable limits. To respond rapidly to these sporadic variations in the burning characteristics and maintain the percentage of CO at an acceptable level, a large amount of air is introduced into the rotary combustor 3 via the overcombustor windbox 25. The amount of air introduced as overcombustor air may be as high as about 30 to 50 percent of the total air supplied to the rotary combustor 3. If this additional air is added via the under fire and overfire windboxes 21 and 23 the additional air increases the rate of burning and does not reduce the sudden CO spikes. By initiating the rapid induction of overcombustor air in response to a drop in the percent of oxygen in the flue gas, the system responds with sufficient speed to burn the CO in the gas space within the combustor 3 by efficiently mixing excess amounts of $O_2$ with the turbulent gases in the combustor 3 to maintain the required average percent of CO over a relatively short time span. This is accomplished by actuating dampers 51 in ducts supplying the overcombustor wind boxes 25. The dampers 51 are operated in response to the change in percent of oxygen ($O_2$) in the flue gasses. The percent of excess $O_2$ is generally controlled at a predetermined set point, for example 6% excess oxygen. The dampers 51 for example would be fully open, if the excess $O_2$ dropped as low as 4% and fully closed, if the excess $O_2$ reached 7%. The embodiment shown introduces overcombustor air into all of the zones Z1 through Z4, however at the present time the introduction of overcombustor air into just zone Z4 is preferred, as it has been effective in providing rapid response to changes in the oxygen level in the flue gas to keep the CO within the prescribed limits even over short time spans.

An additional benefit of this improved method of introducing air into the combustor is that even with the irregular introduction of materials with very high heating values, the high turbulence in the gas space in the combustor cooperates with the low $O_2$ in the burning bed to yield low $NO_x$. Thus, in addition to producing very small allowable quantities of CO, the quantity of $NO_x$ is also keep well below the allowable limits.

While the preferred embodiments described herein set forth the best mode to practice this invention presently contemplated by the inventor, numerous modifications and adaptations of this invention will be apparent to others skilled in the art. Therefore, the embodiments are to be considered as illustrative and exemplary and it is understood that the claims are intended to cover such modifications and adaptations as they are considered to be within the spirit and scope of this invention.

What is claimed is:

1. An improved method of introducing air into a rotary combustor comprising the steps of:

utilizing a rotary combustor formed from a cylindrical array of cooling tubes spaced apart by a web disposed between adjacent tubes, the webs having a plurality of openings disposed along their length for introducing combustion air into the rotary combustor and having an inlet end for introducing solid municipal waste and an outlet end from which ash and flue gases exit;

feeding solid municipal waste into the inlet end of the rotary combustor;

providing a plurality of wind boxes for the rotary combustor to feed air through the openings in the webs of the rotary combustor to separately provide underfire air, overfire air and overcombustor air;

measuring the percent of oxygen in the flue gases;

rapidly introducing overcombustor air into the rotary combustor in response to a drop in the percentage of oxygen in the flue gas to maintain the level of CO in the exhaust gases at acceptable levels.

2. The improved method of introducing air into the rotary combustor of claim 1, wherein the step of introducing overcombustor air comprises introducing overcombustor air so as to provide about 30 to 50% of the air supplied to the rotary combustor as overcombustor air.

3. The improved method of introducing air into the rotary combustor of claim 1, wherein the step of providing wind boxes for the rotary combustor to feed air into the rotary combustor to separately provide underfire air, overfire air and overcombustor air comprises providing at least one wind box for supplying overcombustor air adjacent the outlet end of the combustor.

4. The improved method of introducing air into the rotary combustor of claim 1, wherein the step of rapidly introducing overcombustor air into the rotary combustor is in response to a drop in the percentage of oxygen in the flue gases below a predetermined level.

5. The improved method of introducing air into the rotary combustor of claim 1, wherein the step of introducing overcombustor air comprises opening and closing a damper to regulate the flow of air into the overcombustor windbox.

* * * * *